US008397471B2

(12) United States Patent
Jones

(10) Patent No.: US 8,397,471 B2
(45) Date of Patent: Mar. 19, 2013

(54) TOOL FOR STRAIGHTENING WOODEN PLANKS

(76) Inventor: Michael Jones, Ennis, MT (US)

( * ) Notice: Subject to any disclaimer, the term of this patent is extended or adjusted under 35 U.S.C. 154(b) by 392 days.

(21) Appl. No.: 12/657,495

(22) Filed: Jan. 21, 2010

(65) Prior Publication Data

US 2010/0186344 A1 Jul. 29, 2010

Related U.S. Application Data

(60) Provisional application No. 61/205,653, filed on Jan. 22, 2009.

(51) Int. Cl.

| | |
|---|---|
| ***E04D 15/00*** | (2006.01) |
| ***E04F 21/00*** | (2006.01) |
| ***E04G 21/14*** | (2006.01) |
| ***E04G 23/00*** | (2006.01) |
| ***E02D 37/00*** | (2006.01) |

(52) U.S. Cl. ..... 52/749.1; 52/541; 254/104

(58) Field of Classification Search ..... 52/514, 52/749.1; 254/21, 120, 131, 17, 11, 24, 104
See application file for complete search history.

(56) References Cited

U.S. PATENT DOCUMENTS

| | | | | |
|---|---|---|---|---|
| 1,552,912 | A * | 9/1925 | Colt | 254/104 |
| 2,585,013 | A * | 2/1952 | Johnson | 254/17 |
| 2,896,910 | A * | 7/1959 | Cooper et al. | 254/131 |
| 2,956,777 | A * | 10/1960 | Ames | 254/17 |
| 3,081,537 | A | 3/1963 | Novy et al. | |
| D275,446 | S * | 9/1984 | McSwain | D8/89 |
| 4,621,791 | A * | 11/1986 | Staskiewicz et al. | 254/17 |
| 4,826,136 | A * | 5/1989 | Thomas | 254/25 |
| 4,850,114 | A | 7/1989 | Vocking | |
| 5,249,767 | A * | 10/1993 | Mellen | 248/188.2 |
| 5,787,676 | A * | 8/1998 | Scharf | 52/745.05 |
| 6,508,010 | B2 | 1/2003 | Hanson et al. | |
| 6,955,346 | B2 | 10/2005 | Anderson | |
| 7,311,293 | B2 * | 12/2007 | Mrugalski, Jr. | 254/25 |
| 7,356,972 | B2 | 4/2008 | Leek et al. | |
| 2004/0211152 | A1 | 10/2004 | Aaberg | |
| 2004/0237460 | A1 | 12/2004 | Green | |
| 2010/0186344 | A1 * | 7/2010 | Jones | 52/749.1 |

* cited by examiner

*Primary Examiner* — Andrew Triggs

(57) ABSTRACT

A tool for straightening flooring material laid over floor joists having a thickness includes a square "U" shaped wedge having a pair of spaced apart legs running in parallel. The legs are spaced apart a distance slightly greater than the thickness of the floor joist. A wedge body has a planar bottom side and an upper side tapering with respect to the bottom planar side from a head end downwardly to the distal ends of the legs. A planar chisel plate shaped to conform with the shape of the bottom planar side of the wedge body includes a pair of legs spaced apart a distance slightly smaller than the thickness of the floor joist. The chisel plate includes a chisel edge on each of the distal ends of the legs and further includes a chisel edge along the inside spaced apart edges of the legs of the chisel plate.

5 Claims, 3 Drawing Sheets

TOOL FOR STRAIGHTENING WOODEN PLANKS

This application claims the benefit of provisional application Ser. No. 61/205,653 filed Jan. 22, 2009.

BACKGROUND OF INVENTION

When constructing a deck, decking planks are used to provide the flooring for the deck. These decking planks are conventionally supported by underlying joists to which the decking planks are attached. In many cases the decking planks may run in length from 12 to 16 feet and are commonly 2×6 planks. If the decking planks are not exactly straight, it has been a problem to straighten these planks before attaching them to the underlying floor joists. The present invention provides a tool for straightening these wooden planks when installing decking planks on floor joists.

SUMMARY OF INVENTION

A tool for straightening flooring material laid over floor joists having a thickness includes a squared "U" shaped wedge having a pair of spaced apart legs. The legs are spaced apart a distance slightly greater than the thickness of the floor joist. A wedge body has a planar bottom side and an upper side tapering with respect to the bottom planar side from a head end downwardly to the distal ends of the legs. A squared "U" shaped planar chisel plate shaped to conform with the shape of the bottom planar side of the wedge body includes a pair of legs spaced apart a distance slightly smaller than the thickness of the floor joist. The chisel plate includes a chisel edge along the inside spaced part ledges of the legs of the chisel plate. The tool according to the present invention is used by driving the "U" shaped wedge onto the floor joist with the tapered surface abutting the plank to be straightened. Further as the squared "U" shaped chisel edge wedge is driven downwardly on the joist, the upper tapered surface of the tool forces the plank to be bent away from the wedge body thereby straightening the plank.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
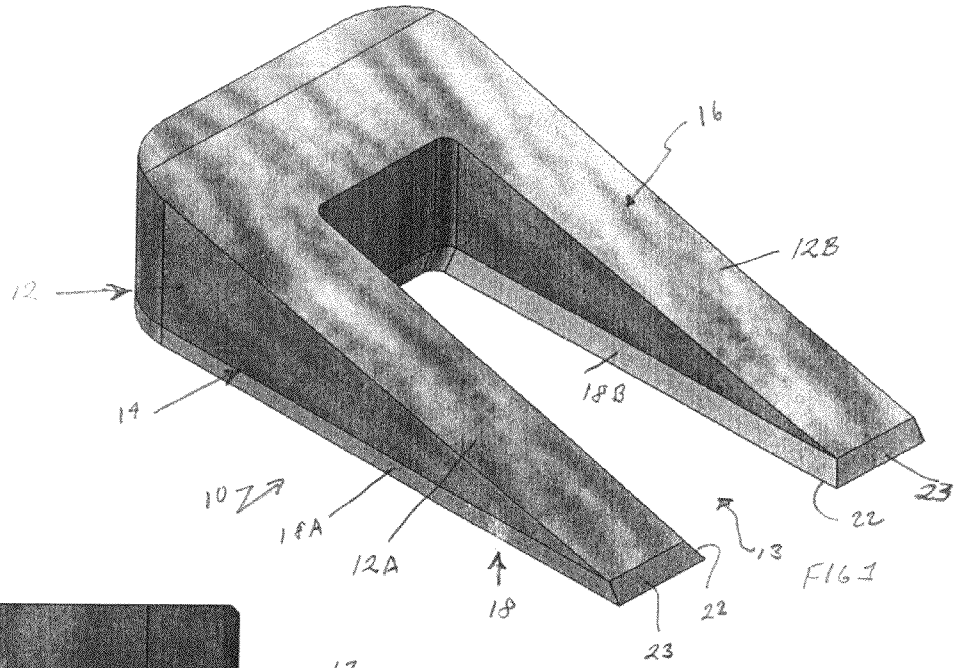
FIG. 1 is a top perspective view of a tool according to the present invention.
Figure 3:
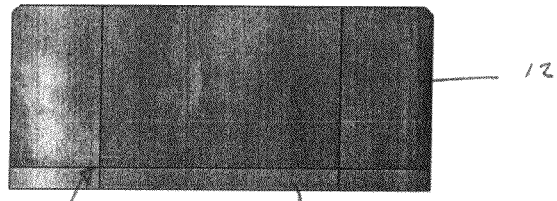
FIG. 3 is a left side elevation view of the tool shown in FIG. 2.
Figure 2:
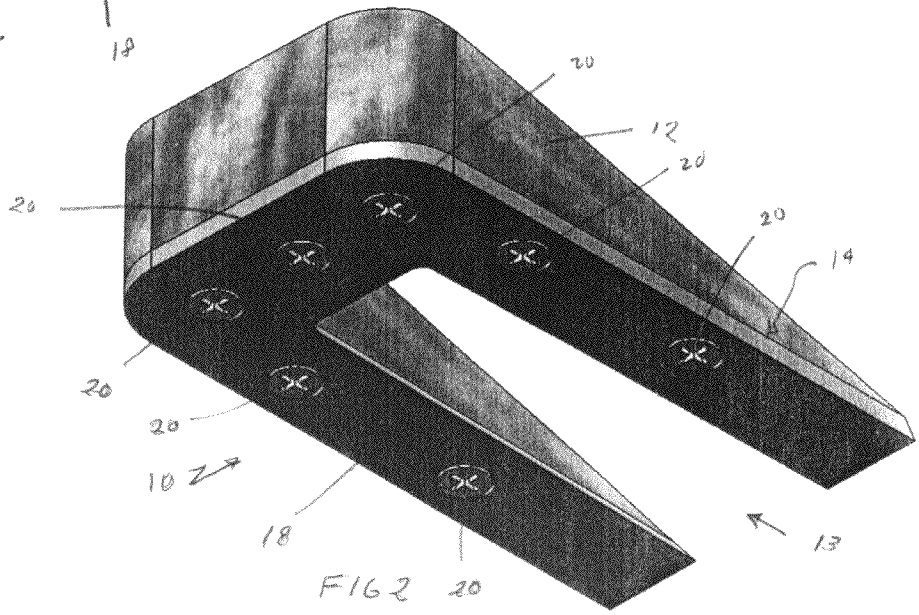
FIG. 2 is a bottom perspective view of the tool shown in FIG. 1.

A tool 10 for straightening wooden planks is shown in FIGS. 1-3. The tool 10 includes a squared "U" shaped wedge body 12 having a pair of spaced apart legs 12A and 12B running parallel with one another together with a flat bottom surface 14. The body 12 also includes an upper surface 16 which is tapered with respect to the bottom surface 14. In a preferred embodiment, the body 12 is constructed of a rigid material such as wood, plastic or steel.

Figure 4:
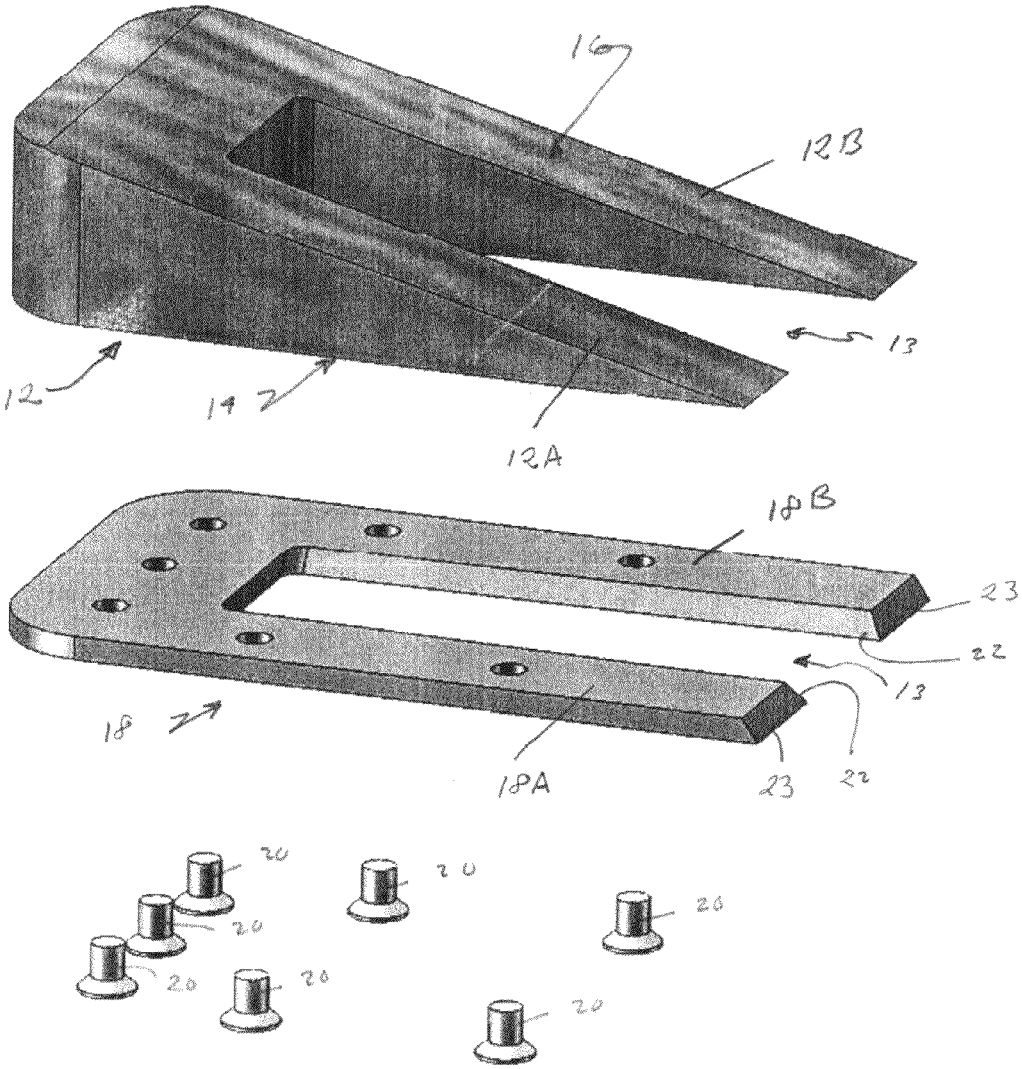
FIG. 4 is an exploded view of the tool shown in FIG. 1.

A squared "U" shaped chisel plate 18 having the same shape as the bottom surface 14, including two spaced apart legs 18A and 18B, is mounted to the body 12 with fasteners 20 as shown in FIGS. 2 and 4. The chisel plate 18 is provided with inwardly extending chisel edges 22 on the legs 18A and 18B as shown in FIGS. 1 and 4 which extend into opening 13 defined by the space between the two legs 12A and 12B of the "U" shaped body 12. The chisel plate 18 is further provided with a chisel edge 23 at each distal end of the legs 18A and 18B.

The present invention has particular application in removing lateral deflection of a wood plank during construction of a wooden deck. However, the present invention could also be used to straighten siding or inside flooring.

Figure 5:
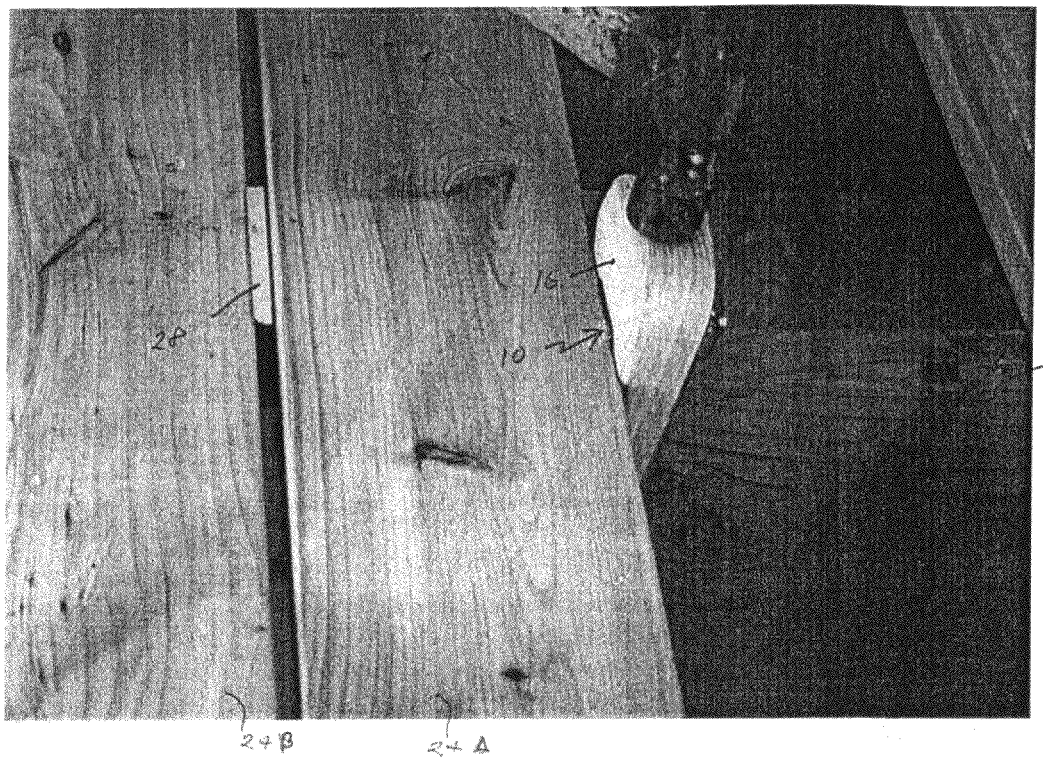
FIG. 5 is a view of the tool being used to straighten a plank.

In conventional construction of a deck, decking planks 24 are laid over floor joists 26 positioned on edge as shown in FIG. 5. If decking plank 24A in FIG. 5 is to be straightened, a spacer 28 is positioned between decking planks 24A and 24B. The tool 10 is then positioned over the joist 26 as shown in FIG. 5 with the opening 13 receiving the edge of joist 26 and with the upper surface 16 positioned in abutting relationship with plank 24A.

The size of the opening 13 receiving the joist 26 is determined by the thickness of the joist with which the tool is to be used. The spaced apart chisel edges 22 are spaced apart a distance slightly less than the thickness of the joist with which the tool 10 is used. By driving the tool 10 downwardly as shown in FIG. 5 with a hammer, for example, the chisel edges 22 will chisel into the joist 26 thereby preventing the tool 10 from moving away from the plank 24A. The tool 10 is driven downwardly with the upper surface 16 wedging the plank 24A against spacer 28. When the plank 24A abuts the spacer 28, screws or nails may be used to secure the plank 24A to the joist 26.

With the present invention, flooring, siding or deck planking can be straightened easily at the time it is installed before securing the flooring, siding or deck planking to the underlying support joists. The tool 10 is easy to use, easy to make and has no moving parts.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

I claim:

1. A flooring material straightening tool for straightening flooring material laid over floor joists having a thickness comprising:

a squared "U" shaped wedge body having a pair of spaced apart legs;

the legs spaced apart a distance slightly greater than the thickness of the floor joists;

the wedge body having a bottom planar side and an upper side tapering with respect to the bottom planar side from a head end downwardly toward a distal end of the legs;

a squared "U" shaped planar chisel plate shaped to conform with the shape of the bottom planar side of the wedge body and having a pair of legs spaced apart a distance creating an opening wherein the legs are spaced apart a distance slightly smaller than the thickness of the floor joists;

the chisel plate having a chisel edge along the inside spaced apart edges of the legs of the chisel plate that chisel into the joist thereby preventing the tool from moving away from the flooring;

the chisel plate mounted to the planar side of the wedge body.

2. The tool according to claim 1 wherein the wedge body is constructed of a rigid material.

3. The tool according to claim 2 wherein the wedge body is constructed from one of wood, plastic and steel and the chisel plate is constructed of metal.

4. The tool according to claim 1 wherein the wedge body and chisel plate are mounted together by fasteners.

5. The tool according to claim 4 wherein the fasteners are metal fasteners.

* * * * *